US010689742B2

(12) United States Patent
Palepu et al.

(10) Patent No.: US 10,689,742 B2
(45) Date of Patent: Jun. 23, 2020

(54) DEVICE AND METHOD FOR IMPROVED EXTRACTION OF METAL VAPOR

(71) Applicants: THYSSENKRUPP STEEL EUROPE AG, Duisburg (DE); thyssenkrupp AG, Essen (DE)

(72) Inventors: Sridhar Palepu, Duisburg (DE); Michael Peters, Kleve (DE); Norbert Schaffrath, Hamm (DE); Sabine Zeizinger, Mülheim (DE)

(73) Assignees: Thyssenkrupp Steel Europe AG, Duisburg (DE); thyssenkrupp AG, Essen (DE)

( * ) Notice: Subject to any disclaimer, the term of this patent is extended or adjusted under 35 U.S.C. 154(b) by 52 days.

(21) Appl. No.: 15/575,477

(22) PCT Filed: May 20, 2016

(86) PCT No.: PCT/EP2016/061483
§ 371 (c)(1),
(2) Date: Nov. 20, 2017

(87) PCT Pub. No.: WO2016/188922
PCT Pub. Date: Dec. 1, 2016

(65) Prior Publication Data

US 2018/0171458 A1 Jun. 21, 2018

(30) Foreign Application Priority Data

May 27, 2015 (DE) ..... 10 2015 108 334

(51) Int. Cl.
*C23C 2/00* (2006.01)
*C23C 2/40* (2006.01)
(Continued)

(52) U.S. Cl.
CPC ..... *C23C 2/02* (2013.01); *C23C 2/003* (2013.01); *C23C 2/06* (2013.01); *C23C 2/40* (2013.01)

(58) Field of Classification Search
None
See application file for complete search history.

(56) References Cited

U.S. PATENT DOCUMENTS

| | | | | |
|---|---|---|---|---|
| 7,617,583 | B2 | 11/2009 | Takahashi et al. | |
| 2013/0160647 | A1 | 6/2013 | Yamauchi et al. | |
| 2015/0167138 | A1 * | 6/2015 | Schaffrath | C23C 2/003 118/68 |

FOREIGN PATENT DOCUMENTS

| | | |
|---|---|---|
| CN | 100471980 C | 3/2009 |
| CN | 202830136 U | 3/2013 |

(Continued)

OTHER PUBLICATIONS

English translation of International Search Report issued in PCT/EP2016/061483 dated Jul. 28, 2016, (mailed Aug. 5, 2016).

(Continued)

*Primary Examiner* — Binu Thomas
(74) *Attorney, Agent, or Firm* — RMCK Law Group PLC

(57) ABSTRACT

A device minimizes or eliminates surface flaws caused by metal dust on a metal strip to be coated in a continuous hot-dip coating process, where at least some segments of the metal strip to be coated are conveyed through the device in an axial direction. The device may comprise a blowing/sucking unit with blow-in openings for applying protective gas to the metal strip, which blow-in openings are positionable on first and second sides of the metal strip. The blowing/sucking unit may further include suction openings for extracting protective gas laden with metal vapor and/or metal dust, which suction openings are positionable on the first and second sides of the metal strip. The blowing/

(Continued)

sucking unit may have a blow-in region in which the blow-in openings are arranged, and a suction region downstream of the blow-in region in which the suction openings are arranged.

11 Claims, 4 Drawing Sheets

(51) Int. Cl.
*C23C 2/02* (2006.01)
*C23C 2/06* (2006.01)

(56) References Cited

FOREIGN PATENT DOCUMENTS

| | | | | |
|---|---|---|---|---|
| DE | 102013104267 | A | | 2/2014 |
| DE | 102013101134 | B | | 5/2014 |
| DE | 102013101131 | A | | 8/2014 |
| DE | 102013101132 | A | | 8/2014 |
| DE | 102012106106 | A | | 9/2014 |
| DE | 102014003473 | A | | 9/2015 |
| DE | 102014003473 | A1 | * | 9/2015 |
| JP | S61246352 | A | | 11/1986 |
| JP | H07157853 | | * | 6/1995 |
| JP | H07157853 | A | | 6/1995 |
| JP | H07157854 | A | | 6/1995 |
| JP | H11302811 | A | | 11/1999 |
| KR | 20030049330 | | * | 6/2003 |
| KR | 20030049330 | A | | 6/2003 |
| WO | 2013005732 | A1 | | 1/2013 |
| WO | 2014006183 | A | | 1/2014 |
| WO | WO-2014006183 | A1 | * | 1/2014 |

OTHER PUBLICATIONS

English abstract of DE102014003473A.
English abstract of DE102012106106A.
English abstract of DE102013101134B.
English abstract of DE102013101132A.
English abstract of DE102013104267A.
Search Report of Chinese Office Action for CN Application No. 2016800306584 dated Apr. 1, 2019, 2 pages.
Japanese Office Action for JP Application No. 2017-560931 dated Mar. 3, 2020.

* cited by examiner

DEVICE AND METHOD FOR IMPROVED EXTRACTION OF METAL VAPOR

CROSS REFERENCE TO RELATED APPLICATIONS

This application is a U.S. National Stage Entry of International Patent Application Ser. No. PCT/EP2016/061483, filed May 20, 2016, which claims priority to German Patent Application No. DE 10 2015 108 334.5, filed May 27, 2015, the entire contents of both of which are incorporated herein by reference.

FIELD The present disclosure generally relates to methods and devices for preventing surface flaws caused by metal dust during hot-dip coating processes.

BACKGROUND

Devices are used for continuous hot-dip galvanizing of steel strip, which consist among other things of a continuous furnace and a zinc bath (melt bath). The steel strip is continuously annealed in the continuous furnace. The desired mechanical properties of the basic material are adjusted in this process by recrystallization of the steel. Furthermore, iron oxides formed in a preheating zone are reduced. In a cooling zone coming after the continuous furnace, the strip is cooled down under protective gas to a temperature near the melt bath temperature. The protective gas is supposed to prevent the annealed strip from being oxidized prior to the galvanization, which would significantly impair the adherence of the zinc layer. A so-called furnace trunk is used as a connecting piece between the continuous furnace and the zinc bath.

To prevent this, a device is known for example from JP 7157853 (A) for the removal of zinc vapor in a trunk of a continuous strip galvanizing layout. In order to remove the zinc vapor arising at the surface of the zinc bath, the furnace trunk is provided on both sides of the strip in each case with a single blow-in opening (circulation opening) and, vertically underneath it, a single suction opening on both sides of the strip. In one exemplary embodiment, the suction openings are each designed as a longitudinal slot in a tube, which passes through a side wall of the trunk and extends over the entire width of the steel strip at the top and bottom side of the steel strip. However, on account of the configuration and arrangement of the blow-in openings and suction openings it is to be assumed that this known device cannot adequately prevent the dispersion of zinc vapor in the furnace trunk and as a result a dispersion of the zinc vapor in the furnace trunk is favored.

This has been attributed to the fact that the steel strip in the trunk moving in the direction of the zinc bath may sometimes entrain protective gas downward in an uncontrolled manner, wherein the entrained protective gas takes up zinc vapor at the surface of the zinc bath, which during the rising of the entrained protective gas is condensed or resublimated at the colder inner walls of the trunk and is deposited there as dust.

To prevent this, it is proposed according to WO 2014/006183 A1 to avoid the entrainment of the protective gas. For this, several blow-in openings and suction openings are provided and the distance between the respective blow-in opening and an associated suction opening is chosen such, and the rate of flow of the protective gas emerging from the respective blow-in opening is controlled such, that an entrainment of protective gas in the direction of the zinc bath occurring during the movement of the metal strip is prevented. This is substantially achieved in that a mixed region with both blow-in openings and suction openings is provided. In other words, the region with blow-in openings and the region with suction openings overlap entirely or are intermeshed like a comb.

However, it has been found that the extraction of zinc vapor is sometimes not adequately achieved with this solution. In particular, it has been found that the blocking of the rising zinc vapor still needs further improvement, due to too direct a mixing of zinc vapor and protective gas in the solutions of the prior art. It has also been determined that an inhomogeneous temperature distribution may still prevail partly in the trunk, which favors a depositing of metal vapor.

Thus a need exists for devices and methods of this kind with which the extraction of metal vapor by means of the protective gas can be improved and the dispersion of metal vapor can be reduced.

DETAILED DESCRIPTION

Figure 1:
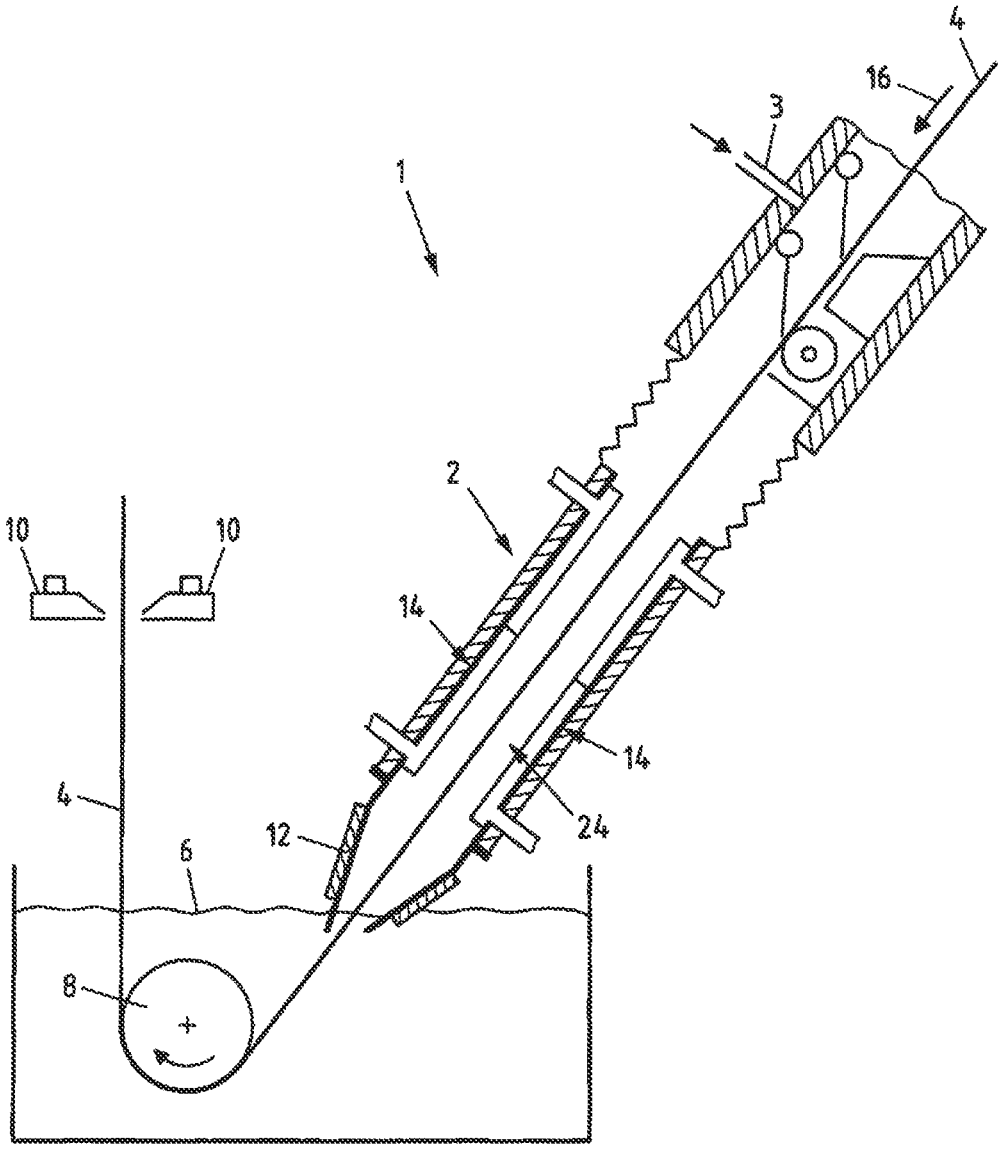
FIG. 1 is a longitudinal sectional view of an example device for carrying out an example method.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates, among other things, to devices for avoiding surface flaws, caused by metal dust, on a metal strip to be coated in a continuous hot-dip coating process, wherein at least some segments of the metal strip to be coated can be conveyed through the devices in an axial direction, comprising a blowing/sucking unit, wherein the blowing/sucking unit has a plurality of blow-in openings for applying protective gas to the metal strip, wherein a plurality of blow-in openings are or can be arranged on a first side of the metal strip and a plurality of blow-in openings are or can be arranged on a second side of the metal strip, wherein the blowing/sucking unit has a plurality of suction openings for extracting protective gas laden with metal vapor and/or metal dust, wherein a plurality of suction openings are or can be arranged on the first side of the metal strip and a plurality of suction openings are or can be arranged on the second side of the metal strip.

The present disclosure also generally relates to methods for avoiding surface flaws, caused by metal dust, on a metal strip to be coated in a continuous hot-dip coating process. One example method may involve conveying at least some segments of the metal strip to be coated through a device, especially through a device according to the invention, in an axial direction, wherein the device comprises a blowing/sucking unit, applying protective gas to the metal strip through a plurality of blow-in openings of the blowing/sucking unit, wherein a plurality of blow-in openings are arranged on a first side of the metal strip and a plurality of blow-in openings are arranged on a second side of the metal strip, and extracting protective gas laden with metal vapor and/or metal dust through a plurality of suction openings of the blowing/sucking unit, wherein a plurality of suction openings are arranged on the first side of the metal strip and a plurality of suction openings are arranged on the second side of the metal strip.

The drawbacks of the prior art are eliminated in a device of this kind and in a method of this kind in that the blowing/sucking unit has a blow-in region, in which the blow-in openings are arranged, and a suction region, which is arranged after the blow-in region looking in the axial direction, in which the suction openings are arranged.

It has been found that the properties of the device and the method can be distinctly improved by arranging the suction region behind the blow-in region, looking in the axial direction (that is, the direction of movement of the strip). Thus, the invention deliberately departs from the most recent prior art, which calls for a mixed arrangement of blow-in openings and suction openings, and pursues an opposite approach. While this likewise calls for a plurality of blow-in openings and suction openings, they are provided in separate regions arranged one behind the other. It has been found that the combination of, on the one hand, a plurality of openings on each side of the strip and, on the other hand, no mixed arrangement, but instead a separate arrangement of the blow-in openings on the one hand and the suction openings on the other hand in regions situated one behind the other, is advantageous on account of many effects.

In particular, the device and the method can achieve an improved extraction of metal vapor and an effective blocking system for rising metal vapor, for example in a furnace trunk. This is attributed, among other things, to the fact that the arrangement and configuration of the blow-in region and the suction region can reduce the direct mixing of metal vapor and protective gas. Furthermore, it has been found that the device and the method can achieve a better, that is, a homogeneous, temperature distribution in the trunk, which in turn prevents a local condensing or resublimating of metal vapor. Moreover, a forced guidance of sideways rising metal vapors can be prevented. The relatively simple design remains substantially independent of the width of a furnace trunk being used. As a result, the device and the method can finally also be used for relatively large metal vapor concentrations.

The continuous hot-dip coating process can be in particular a continuous hot-dip galvanization. Accordingly, the metal bath or melt bath can be in particular a zinc bath. Accordingly, the metal vapor or metal dust can be in particular zinc vapor or zinc dust. Accordingly, the coating can be in particular a galvanization.

The metal strip can be in particular a steel strip. For example, the steel strip is conveyed through the device in a coil-to-coil process. The first side of the metal strip is for example a top side or front side of the metal strip. The second side of the metal strip is for example a bottom side or back side of the metal strip. The metal strip may have for example a width of at least 1000 mm, preferably at least 1300 mm, especially preferably at least 1500 mm. It has been found that the device and the method are also suitable for very broad strips.

The metal strip may for example be conveyed at a strip speed of at least 80 m/min, preferably at least 100 m/min, especially preferably at least 120 m/min in the axial direction. For example, the strip speed is at most 180 m/min. Even at these high speeds, an effective blockage for the zinc vapor and homogeneous temperatures can be achieved.

Other blowing/sucking units can also be provided in the device and the method. Thus, at least one blowing/sucking unit is provided. By a/the blowing/sucking unit is therefore meant at least one/the at least one blowing/sucking unit.

Because the suction region is arranged behind the blow-in region, looking in the axial direction, the metal strip conveyed in the axial direction at first moves through the blow-in region and then through the suction region. The blow-in region in particular is free of suction openings and the suction region is free of blow-in openings. That is, the blow-in openings and the suction openings are physically separate from each other. For example, the blow-in region and the suction region directly border on one another.

The blow-in openings and/or the suction openings may be provided, for example, at least partly as boreholes, which simplifies the fabrication of the device.

The protective gas is for example a gas which prevents the oxidation of the metal strip. For example, the protective gas is a hydrogen nitrogen mixture (HNX). For example, the protective gas comprises around 95% $N_2$ and around 5% $H_2$.

The protective gas is blown in for example with a temperature of at least 430° C., preferably at least 440° C., further preferably with a temperature of at least 550° C., especially with a temperature of around 600° C. In this way, a condensation or resublimation of the metal vapor is further prevented.

According to one preferred embodiment of the device according to the invention, the blow-in openings and the suction openings are provided such that the protective gas blown in through the blow-in openings of the blow-in region is at first deliberately entrained with the metal strip conveyed through the device in the axial direction and flows in the axial direction, after which it flows contrary to the axial direction to the suction openings of the suction region. The blow-in openings and the suction openings may be arranged and/or configured accordingly for this, for example.

Accordingly, according to one preferred embodiment of the method according to the invention, the protective gas blown in through the blow-in openings of the blow-in region is at first deliberately entrained with the metal strip conveyed through the device in the axial direction and flows in the axial direction, after which it flows contrary to the axial direction to the suction openings of the suction region.

It has been found that a targeted flow of the protective gas can be achieved by arranging the suction region behind the blow-in region, looking in the axial direction. In this way, quite contrary to the objective of the prior art, the entrainment of the protective gas by the metal strip is deliberately provoked, rather than preventing it. In this way, a direct mixing of metal vapor and protective gas is reduced and an effective barrier system is provided for rising metal vapor. At the same time, an especially homogeneous temperature distribution is achieved. The device and the method are therefore suitable as well for relatively high metal vapor concentrations, which thus far could not be handled adequately.

For example, the protective gas blown in at first flows along the surface of the metal strip with the metal strip in the axial direction, until the flow impinges on the surface of the metal bath or melt bath and is deflected there. For example, the protective gas here takes up a large portion of the metal vapors of the metal bath. The protective gas then flows at a distance from the surface of the metal strip, for example along a wall, such as that of a furnace trunk, contrary to the axial direction, toward the suction openings of the suction region. Thus, the result is a continuous flowing of the protective gas, so that an uninterrupted metal vapor extraction is achieved.

According to one preferred embodiment of the device according to the invention, the blow-in region and the suction region are arranged free of overlapping. By overlapping is meant in particular that that one region at least partly coincides with the other region. The blow-in region formed by the blow-in openings and the suction region formed by the suction openings therefore do not overlap. For example, looking in the axial direction, at first only blow-in openings are provided and then only suction openings. It has been found that as a result the extraction of metal vapor by the protective gas can be further improved, and the dispersion of metal vapor can be further reduced.

According to another embodiment of the device according to the invention, the blow-in openings of the blow-in region and/or the suction openings of the suction region are at least partly arranged in a regular pattern, in particular with a shortest spacing of at least 30 mm, preferably at least 40 mm, especially preferably at least 60 mm. In this way, in particular an especially homogeneous temperature distribution can be achieved and on the other hand a further optimized flow of the protective gas can be achieved, which counteracts the dispersion of metal vapor.

For example, the blow-in openings of the blow-in region and the suction openings of the suction region are arranged in the same regular pattern. For example, the blow-in openings and/or the suction openings are arranged in a rectangular pattern. In other words, the blow-in openings and/or the suction openings lie for example at the nodes of an (imaginary) two-dimensional rectangular lattice. For example, the shortest spacing of the blow-in openings and/or the suction openings in the axial direction is greater than that transversely to the axial direction. For example, the shortest spacing of the blow-in openings and/or the suction openings in the axial direction is between 50 mm and 150 mm, preferably between 80 mm and 120 mm, especially preferably between 90 mm and 110 mm. For example, the shortest spacing of the blow-in openings and/or the suction openings in the axial direction is around 100 mm. For example, the shortest spacing of the blow-in openings and/or the suction openings transversely to the axial direction is between 30 mm and 90 mm, preferably between 40 mm and 80 mm, especially preferably between 50 mm and 70 mm. For example, the shortest spacing of the blow-in openings and/or the suction openings transversely to the axial direction is around 60 mm.

According to one preferred embodiment of the device according to the invention, at least some of the suction openings are designed larger than the blow-in openings. By the size of the blow-in openings or suction openings is meant in particular the (average) diameter of the opening. The diameter of the blow-in openings is preferably between 5 mm and 10 mm, preferably around 8 mm. The diameter of the suction openings is preferably between 8 mm and 15 mm, preferably around 10 mm. It has been found that this can achieve a further improved flow in terms of an efficient metal vapor extraction.

It is furthermore advantageous in this regard for the standard volume flow for the extraction to be larger than the standard volume flow for the blowing in. For example, the standard volume flow for the blowing in is at least 100 $Nm^3/h$ (standard cubic meter), preferably at least 150 $Nm^3/h$, per side of the metal strip. For example, the standard volume flow is 100-300 $Nm^3/h$. However, the standard volume flow may also be even higher, depending on the width of the device. For example, the standard volume flow for the extraction is at least 150 $Nm^3/h$, preferably at least 200 $Nm^3/h$, per side of the metal strip. For example, the standard volume flow is 150-400 $Nm^3/h$. However, the standard volume flow may also be even higher, depending on the width of the device.

According to another embodiment of the device according to the invention, at least some of the blow-in openings are provided so that the protective gas flows substantially transversely to the axial direction from the blow-in openings in the direction of the respective side of the metal strip.

The blow-in openings are for example arranged and/or configured accordingly for this.

Accordingly, the protective gas according to one preferred embodiment of the method according to the invention flows substantially transversely to the axial direction in the direction of the respective side of the metal strip from the blow-in openings.

It has been found that in this way the flow behavior of the protective gas can be further optimized, which results in particular in less dispersion of metal vapor.

For example, the protective gas flowing from the blow-in openings is directed at an angle of 70° to 110°, preferably 80° to 100°, especially preferably around 90° in the direction of the respective side of the metal strip.

According to another embodiment of the device according to the invention, the blowing/sucking unit comprises a first blowing/suction box, which is or can be arranged on the first side of the metal strip to be coated, and a second blowing/suction box, which is or can be arranged on the second side of the metal strip to be coated. The device may also comprise even more blowing/suction boxes.

By providing blowing/suction boxes, the applying of protective gas to the metal strip from both sides can be realized by an especially simple design. Furthermore, the blowing/suction boxes enable, for example, a scalability of the device in an easy manner. Moreover, the blowing/suction boxes can achieve a two-dimensional application of the protective gas and extraction of the metal vapor. The blowing/suction boxes are substantially flat in configuration, for example. For example, the blowing/suction boxes have at least one port for blowing in the protective gas and at least one port for extracting the mixture of protective gas and metal vapor/metal dust.

According to another embodiment of the device according to the invention, the blowing/suction boxes each have at least one blowing box for providing the blow-in region and at least one suction box for providing the suction region. By providing separate blowing boxes and suction boxes, a physically separate arrangement of the blow-in region and the suction region can be achieved in a simple manner. For example, a blowing box and a suction box can be separated from each other by a partition wall. Likewise, a blowing/suction box may also comprise several blowing boxes and/or suction boxes. These can also be separated from one another by a partition wall, for example. For example, the blowing boxes and/or the suction boxes each have one port for blowing in the protective gas or for extracting the mixture of protective gas and metal vapor/metal dust.

According to another embodiment of the device according to the invention, the device comprises a furnace trunk for connection of a continuous furnace to a metal bath, wherein the blowing/sucking unit is provided at least partly in the furnace trunk.

Accordingly, the method according to one preferred embodiment of the method is carried out at least partly in a furnace trunk for connection of a continuous furnace to a metal bath.

For example, the furnace trunk may be at least partly heated, for example to a temperature of at least 400° C., preferably at least 450° C. The furnace trunk for example has an entry opening for introducing the metal strip and an exit opening for the exiting of the metal strip. The furnace trunk tapers for example at least for a section for example from the entry opening in the direction of the exit opening.

According to one preferred embodiment of the method according to the invention, a barrier gas is supplied to the device before the blowing/sucking unit, looking in the axial direction. For this, the device may have for example a barrier gas feed line. For example, the protective gas may likewise be used as the barrier gas and the barrier gas corresponds to the already described composition, such as (HNX). For example, the barrier gas is blown in with at least 300 $Nm^3/h$, for example at one side. Advantageously, different pressure relations per region can be achieved with a variable-pressure gas feed line. By feeding the barrier gas, it is possible for example to shield the gas flow in the trunk from a furnace and thus prevent an entrainment of zinc vapor into other parts of the device, such as the furnace.

According to one preferred embodiment of the device according to the invention, the device furthermore comprises one or more of the following units: a continuous furnace located upstream from the blowing/sucking unit for heating the metal strip to be coated; a metal bath, especially a zinc bath, located after the blowing/sucking unit, for the coating of the metal strip and optionally a stripping device located after the metal bath to adjust the thickness of the coating of the metal strip; a separating device for cleaning the protective gas extracted through the suction openings and laden with metal vapor and/or metal dust; a heating device for heating the protective gas fed through the blow-in openings, especially to a temperature of more than 430° C.

Accordingly, the method according to one preferred embodiment of the method according to the invention additionally comprises one or more of the steps: heating of the metal strip to be coated in a continuous furnace located upstream from the blowing/sucking unit; coating of the metal strip in a metal bath, especially a zinc bath, located after the blowing/sucking unit, and optionally adjusting the thickness of the coating of the metal strip by a stripping device located after the metal bath; cleaning of the protective gas extracted through the suction openings and laden with metal vapor and/or metal dust in a separating device; heating of the protective gas fed through the blow-in openings in a heating device, especially to a temperature of more than 430° C.

The temperature of the metal bath is for example between 400° C. and 500° C., preferably between 440° C. and 470° C.

The stripping device can be realized for example by air nozzles, such as flat air jet nozzles.

The zinc separating device can preferably be provided with a cooling device, which brings about a resublimation of the metal vapor. The thus created metal dust can be separated by means of a separating device from the protective gas and be conveyed for example to a collecting tank.

The above and the following description of steps of the method according to preferred embodiments of the method will also disclose corresponding means or devices to carry out the steps of the method by preferred embodiments of the device. Likewise, the disclosure of means for carrying out a step of the method will disclose the corresponding step of the method.

FIG. 1 shows a longitudinal sectional view of an exemplary embodiment of a device 1 according to the invention in the form of a continuous hot-dip galvanization layout for carrying out an exemplary embodiment of a method according to the invention. The device 1 comprises in particular a furnace trunk 2. A metal strip 4 to be galvanized, such as a steel strip, is annealed in a continuous furnace (not shown) and supplied under protective gas (HNX) to a zinc bath 6. The strip 4 dips down at a slant into the zinc bath 6 and is deflected upward by a roller 8 arranged in the zinc bath 6. The bath temperature is typically in the range of around 440° C. to 470° C. Upon emerging from the bath 6, the strip 4 entrains a quantity of liquid zinc, which may lie significantly above the desired coating thickness. The still liquid excess coating material is stripped off from the first side and the second side (that is, the top and bottom or front and back side) of the now coated strip 4 by flat air jet nozzles 10 extending across the width of the strip.

In order to avoid too intense a cooldown (especially below the dew point or resublimation temperature of the protective gas/zinc vapor mixture) of the furnace trunk 2 in the region near the zinc bath 6, insulating elements 12 (such as mineral wool and/or ceramic tiles) may be provided optionally.

The furnace trunk 2 among other things is meant to prevent the annealed strip 4 from being oxidized before the galvanization, which would impair the adherence of the zinc layer. Therefore, the strip 4 is subjected to protective gas. At the same time, the protective gas should serve to prevent the dispersion of zinc vapor. For this reason, the furnace trunk 2 is outfitted with a special blowing/sucking unit 14, which applies protective gas to the metal strip 4 and extracts the protective gas laden with zinc vapor and/or zinc dust.

Figure 2:
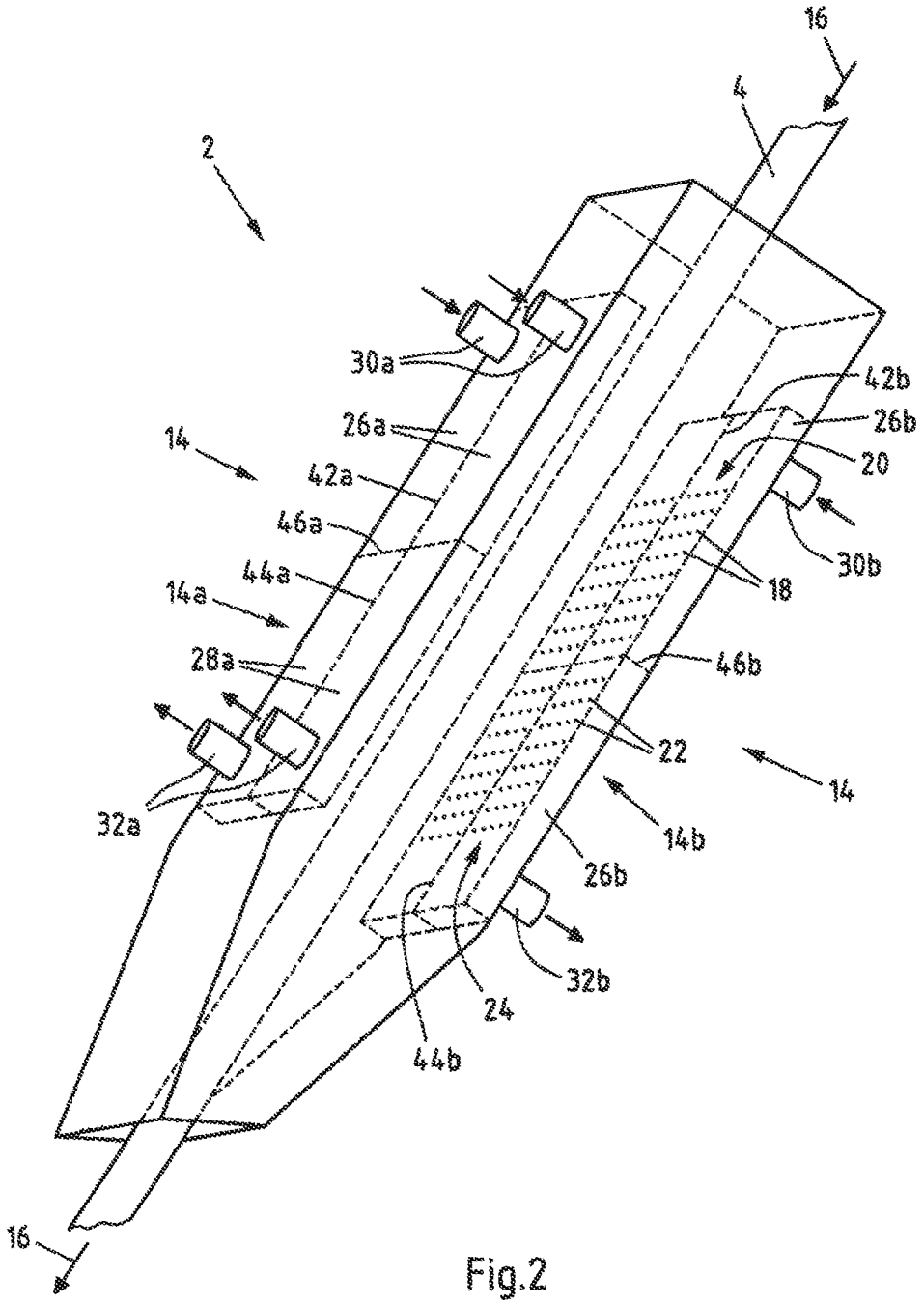
FIG. 2 is a perspective view of an example furnace trunk from FIG. 1.
Figure 3:
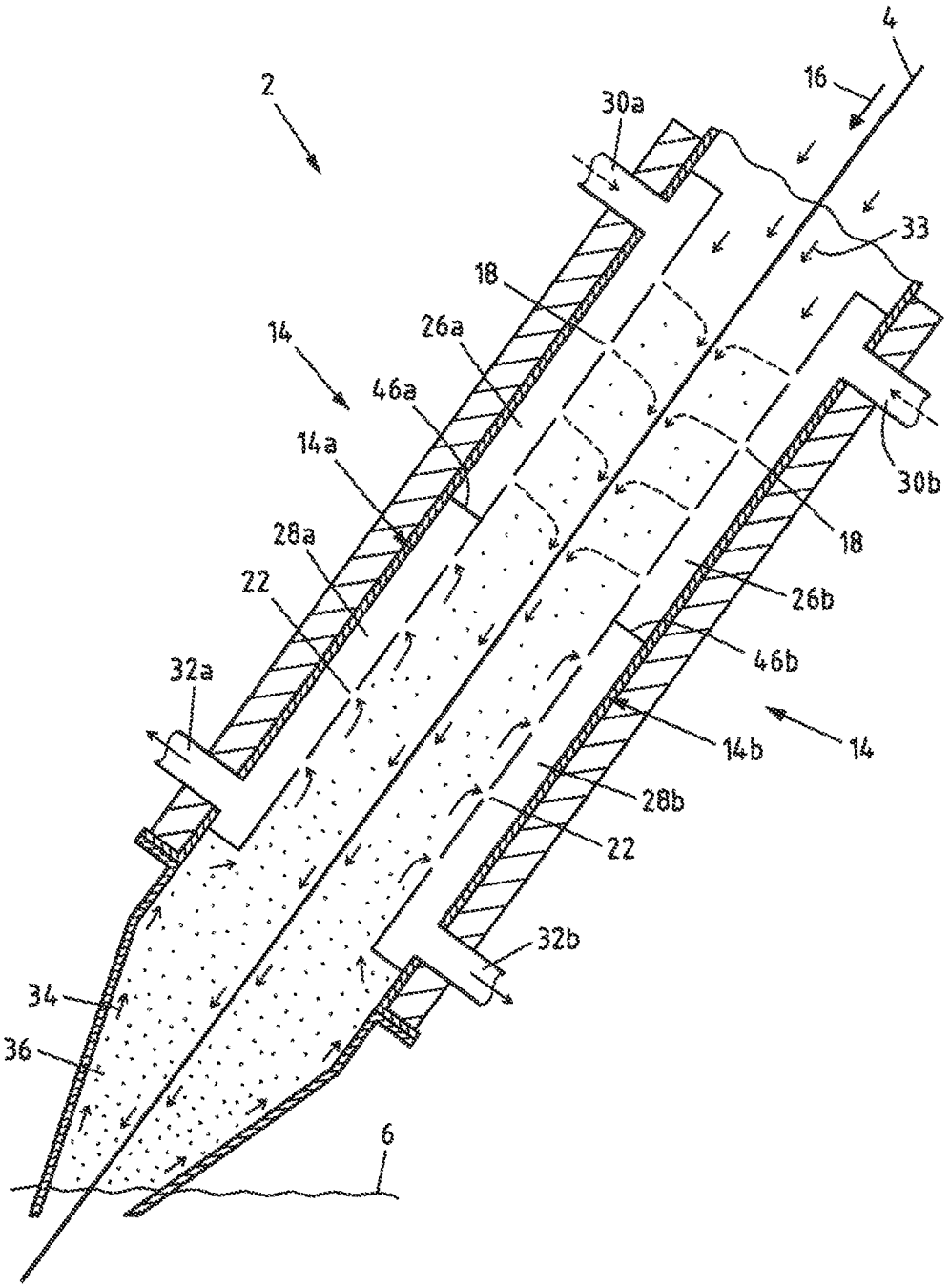
FIG. 3 is a longitudinal sectional view of the example furnace trunk from FIG. 1.

FIG. 2 shows a perspective representation of the furnace trunk 2 from FIG. 1 and FIG. 3 shows a longitudinal sectional view of the furnace trunk 2 from FIG. 1.

The metal strip 4 to be coated is conveyed in this section along an axial direction 16 through the furnace trunk 2 and through the blowing/sucking unit 14 of the device 1. The blowing/sucking unit 14 has a plurality of blow-in openings 18 for applying protective gas to the metal strip 4. A plurality of blow-in openings 18 are arranged on a first side of the metal strip and a plurality of blow-in openings 18 on a second side of the metal strip, so that the metal strip 4 can be subjected to the protective gas on both sides. The blow-in openings 18 form a blow-in region 20. Furthermore, the blowing/sucking unit 14 has a plurality of suction openings 22 for extracting protective gas laden with metal vapor and/or metal dust. A plurality of suction openings 22 are arranged on the first side of the metal strip 4 and a plurality of suction openings 22 are arranged on the second side of the metal strip 4. The suction openings 22 form a suction region 24.

The blow-in region 20, in which the blow-in openings 18 are arranged, is arranged behind the suction region 24, in which the suction openings 22 are arranged, looking in the axial direction 16. The blow-in region 20 and the suction region 24 are arranged free of overlap.

The blowing/sucking unit 14 comprises a first blowing/suction box 14*a*, which is arranged on the first side of the metal strip 4 to be coated, and a second blowing/suction box 14*b*, which is arranged on the second side of the metal strip 4 to be coated. The blowing/suction boxes 14*a*, 14*b* each have two blowing boxes 26*a* and 26*b* for providing the blow-in region 20 and two suction boxes 28*a* and 28*b* for providing the suction region 24. The blowing boxes 26*a* (or 26*b*) are separated from each other in each case by a partition wall 42*a* (or 42*b*). The suction boxes 28*a* (or 28*b*) are also separated from each other by a partition wall 44*a* (or 44*b*). The blowing box 26*a* (or 26*b*) and the suction box 28*a* (or 28*b*) are likewise separated from each other by a partition wall 46*a* (or 46*b*).

The individual blowing boxes 26*a*, 26*b* each have separate ports 30*a*, 30*b* for the supply of protective gas. The standard volume flow for the blowing in through the ports 30*a* is around 150 $Nm^3/h$. The standard volume flow for the blowing in through the ports 30*b* is likewise around 150 $Nm^3/h$. The standard volume flow for the extraction through the ports 32*a* is around 200 $Nm^3/h$. The standard volume flow for the extraction through the ports 32*b* is likewise around 200 $Nm^3/h$.

At the same time, barrier gas can be fed to the device 1 by means of the barrier gas feed line 3 (see FIG. 1). The barrier gas here is identical to the protective gas and it is blown in at 300 $Nm^3/h$ through the barrier gas feed line 3, as is also illustrated by the arrows 33 in FIG. 3. The barrier gas is advantageously fed in between two sealing flaps (see FIG. 1). The barrier gas shields the gas flow in the furnace trunk 2 against a furnace located upstream, so that an entrainment of zinc vapor into the furnace is prevented. For example, the pressure drops off from the region of the protective gas feed line 3 via the region of the blowing boxes 26*a* and 26*b* to the region of the suction boxes 28*a* and 28*b*.

As is especially evident in FIG. 3, the blow-in openings 18 are provided such that the protective gas flows substantially transversely to the axial direction 16 from the blow-in openings in the direction of the respective side of the metal strip 4. The protective gas in this case is blown through the blow-in openings 18 perpendicularly in the direction of the respective side of the metal strip 4. The direction of flow of the protective gas is illustrated by the arrows 34. The protective gas blown in through the blow-in openings 18 of the blow-in region 20 is at first deliberately entrained with the metal strip 4 being conveyed through the device 1 in the axial direction 16 and flows in the axial direction 16. The protective gas flows along the surface of the metal strip 4. After this, the protective gas mixed with zinc vapor and zinc dust flows along the wall of the furnace trunk 2 contrary to the axial direction 16 toward the suction openings 22 of the suction region 24.

The dots 36 illustrate the distribution and the concentration of the zinc vapor and zinc dust. The concentration of the zinc dust and zinc vapor decreases evidently opposite the axial direction 16. The blowing/sucking unit 14 enables an effective barrier for the zinc vapor and the zinc dust and an effective extraction of the zinc vapor and zinc dust.

For example, if one assumes a zinc vapor input of around 34 g/h by the zinc bath 6, simulations reveal a zinc vapor concentration of around $5\times10^{-5}$ $kg/m^3$ in the vicinity of the zinc bath 6 in the lower region of the furnace trunk. In the suction region 24 there is still present a zinc vapor concentration of around $3\times10^{-5}$ $kg/m^3$ to around $7\times10^{-6}$ $kg/m^3$. In the blow-in region 20, the zinc vapor concentration is already less than $7\times10^{-6}$ $kg/m^3$.

For a larger zinc vapor input of 340 g/h, one still gets zinc vapor concentrations of up to $5\times10^{-5}$ $kg/m^3$ in the suction region 24. However, they drop off in the blow-in region 20 to less than $1\times10^{-5}$ $kg/m^3$, in part also to below $7\times10^{-6}$ $kg/m^3$. Thus, the device and the method are also suitable for such high zinc vapor inputs.

Figure 4:
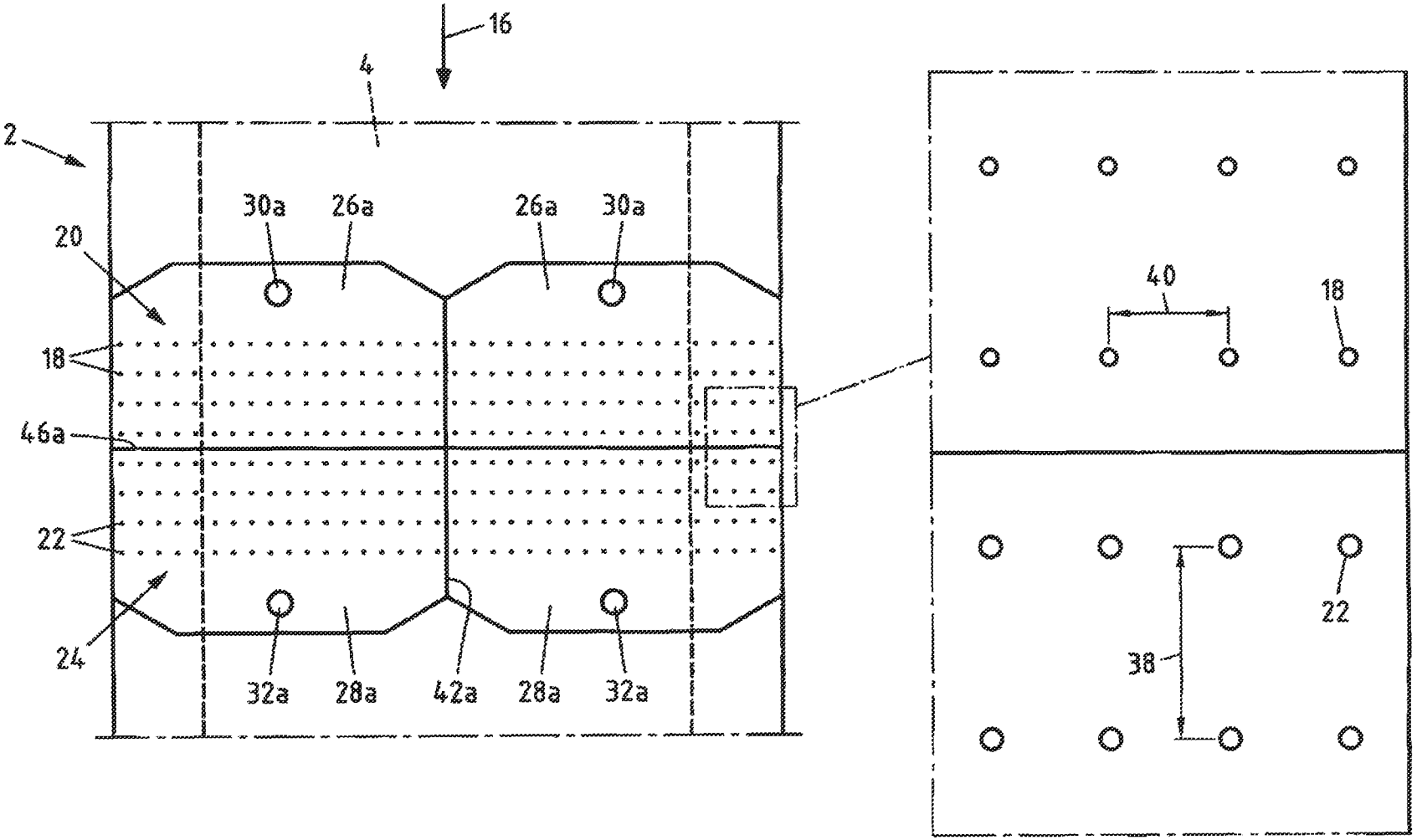
FIG. 4 is a top view of an example blow-in region and an example suction region of an example blowing/suction box of FIG. 1.

FIG. 4 finally shows as an example a top view of the blow-in region 20 and the suction region 24 of the blowing/suction box 14*a* from FIG. 1. The blow-in openings 18 of the blow-in region 20 and the suction openings 22 of the suction region 24 are arranged in a regular pattern. The shortest spacing of neighboring openings 18, 22 in the axial direction 16 is greater than that transversely to the axial direction 16. The shortest spacing 38 of the blow-in openings 18 or the suction openings 22 in the axial direction amounts to around 100 mm here. The shortest spacing 40 of the blow-in openings 18 or the suction openings 22 transversely to the axial direction 16 amounts to around 60 mm. The blow-in openings 18 are configured smaller than the suction openings 22. The diameter of the blow-in openings 18 is around 8 mm. The diameter of the suction openings 22 is around 10 mm.

What is claimed is:

1. A device that minimizes or eliminates surface flaws caused by metal dust on a metal strip to be coated in a continuous hot-dip coating process, wherein at least some segments of the metal strip to be coated are configured to be conveyed through the device in an axial direction, the device comprising a blowing/sucking unit that comprises:

a blow-in region that includes a plurality of blow-in openings for applying protective gas to the metal strip, wherein some of the plurality of blow-in openings are positionable on a first side of the metal strip and some of the plurality of blow-in openings are positionable on a second side of the metal strip;

a suction region that includes a plurality of suction openings for extracting the protective gas, which is laden with at least one of metal vapor or metal dust, wherein some of the plurality of suction openings are positionable on the first side of the metal strip and some of the plurality of suction openings are positionable on the second side of the metal strip;

a first blowing/suction box that is positionable on the first side of the metal strip, the first blowing/suction box comprising a first pair of blowing boxes at the blow-in region and a first pair of suction boxes at the suction region, the first pair of blowing boxes and the first pair of suction boxes separated by a first partition wall; and wherein the suction region is positioned downstream of the blow-in region with respect to the axial direction and wherein the blow-in region and the suction region are free of overlapping in the axial direction.

2. The device of claim 1 wherein the plurality of blow-in openings and the plurality of suction openings are disposed such that the protective gas blown in through the plurality of blow-in openings of the blow-in region is entrained with the metal strip conveyed through the device in the axial direction and flows in the axial direction, after which the protective gas flows contrary to the axial direction to the plurality of suction openings of the suction region.

3. The device of claim 1 wherein the blow-in region and the suction region are disposed at mutually exclusive locations of the blowing/sucking unit.

4. The device of claim 1 wherein at least one of the plurality of blow-in openings or the plurality of suction openings are at least partially disposed in a pattern.

5. The device of claim 4 wherein the plurality of blow-in openings or the plurality of suction openings in the pattern are spaced at least 40 mm apart.

6. The device of claim 1 wherein at least some of the plurality of suction openings are larger than the plurality of blow-in openings.

7. The device of claim 1 wherein at least some of the plurality of blow-in openings are disposed such that the protective gas flows substantially transversely to the axial direction from the plurality of blow-in openings in a direction of a respective side of the metal strip.

8. The device of claim 1 wherein the blowing/sucking unit further comprises:

a second blowing/suction box that is positionable on the second side of the metal strip.

9. The device of claim 1 further comprising a furnace trunk for connection of a continuous furnace to a metal bath, wherein the blowing/sucking unit is disposed at least partly in the furnace trunk.

10. The device of claim 1 further comprising at least one of:

a continuous furnace disposed upstream of the blowing/sucking unit for heating the metal strip;

a metal bath disposed downstream of the blowing/sucking unit for coating the metal strip;

a separating device for cleaning the protective gas extracted through the plurality of suction openings; or a heating device for heating the protective gas fed through the plurality of blow-in openings.

11. The device of claim 8 wherein the second blowing/suction box comprises a second pair of blowing boxes at the blow-in region and a second pair of suction boxes at the suction region, wherein the second pair of blowing boxes and second pair of suction boxes are separated by a second partition wall.

* * * * *